US005698164A

United States Patent [19]

Kishioka et al.

[11] Patent Number: 5,698,164

[45] Date of Patent: Dec. 16, 1997

[54] LOW-TEMPERATURE PLASMA GENERATOR

[75] Inventors: Takashi Kishioka, 3-20, 2-chome, Dairyo, Sumiyoshi-ku, Osaka; Kazuya Nagata, Okayama; Norihide Nishida, Kamogata-cho; Masaki Nieda, Sanyo-cho, all of Japan

[73] Assignees: Takashi Kishioka, Osaka; Okayama-Ken; Ohnit Co., Ltd., both of Okayama, all of Japan

[21] Appl. No.: 413,696

[22] Filed: Mar. 30, 1995

[30] Foreign Application Priority Data

Dec. 27, 1994 [JP] Japan ..... P6-326232

[51] Int. Cl.[6] ..... H05H 1/24

[52] U.S. Cl. ..... 422/121; 422/186.18; 422/186.07; 315/111.21; 361/230

[58] Field of Search ..... 422/22, 121, 186.07, 422/186.18; 361/230, 229, 231, 232, 213, 222; 315/111.21, 111.81

[56] References Cited

U.S. PATENT DOCUMENTS

| | | | |
|---|---|---|---|
| 2,710,835 | 6/1955 | Pardey | 422/186.18 |
| 3,677,931 | 7/1972 | O'Hare | 422/186.18 X |
| 3,742,301 | 6/1973 | Burris | 422/186.18 X |
| 4,214,995 | 7/1980 | Saylor | 250/539 |
| 4,656,010 | 4/1987 | Leitzke et al. | 422/186.18 |
| 4,690,803 | 9/1987 | Hirth | 422/186.18 |
| 4,770,858 | 9/1988 | Collins | 422/186.18 |
| 4,960,570 | 10/1990 | Mechtersheimer | 422/186.07 X |
| 5,458,856 | 10/1995 | Marie et al. | 422/186.07 X |

*Primary Examiner*—Robert J. Warden
*Assistant Examiner*—E. Leigh Dawson
*Attorney, Agent, or Firm*—Koda and Androlia

[57] ABSTRACT

The present invention provides a low-temperature plasma generator as an electric discharger which is used for discharging electricity in dry air, humid air or water, thereby removing an offensive odor, sterilizing bacteria, purifying water and so on. In the low-temperature plasma generator, rod electric conductors are inserted in through-holes formed in rod ceramics dielectric members and extending in longitudinal directions thereof, both ends of the electric conductors and the dielectric members are integrally joined and sealed by glass or an inorganic or organic adhesive, so as to constitute a plurality of electrodes, and the electrodes are connected to each other through the ceramics dielectric members in line-contacted relation.

2 Claims, 4 Drawing Sheets

LOW-TEMPERATURE PLASMA GENERATOR

BACKGROUND OF THE INVENTION

1. Industrial Field of the Invention

The present invention relates to a low-temperature plasma generator as an electric discharger which is applicable to various kinds of devices to purify drinking water or water in a pool, to remove a bad smell emitted from a cigarette, a pet, refuse or the like, to destroy an offensive odor in a toilet, to sterilize mold or bacteria, and to preserve freshness of food in a refrigerator or freezer.

2. Prior Art

As an example of a device which utilizes the electric discharger, an ozone generator will now be described. The conventional ozone generator has been commonly used in an industrial field, and it generates ozone ($O^3$) in dry air by its electric-discharge function. The ozone thus generated has such a high reactivity that it is utilized for removing an offensive odor or for sterilizing mold or bacteria. In a large-sized electric discharger to generate ozone, glass or ceramics (dielectric member) is interposed between metallic plates (electric conductors). In a small-sized electric discharger, ① metallic plates (electric conductors) are mounted on a ceramics plate (dielectric member), or ② electrodes comprising metallic members (electric conductors) coated with glass (dielectric member), are provided opposite to each other.

SUMMARY OF THE INVENTION

In recent years, various investigations and studies have been made to utilize the above-described characteristic of ozone for the purpose of purifying drinking water or water in a pool, or preserving freshness of food in a refrigerator or freezer. The conventional electric discharger is, however, inadequate to use in high-humidity air or water. In the former discharger in which the metallic plates are mounted on the ceramics plate, the electric conductors exposed to the high-humidity air or water are restrained from electrically discharging so that they cannot generate ozone efficiently. The latter discharger in which the electrodes comprising the metallic members coated with the glass are provided opposite to each other, is usable in the high-humidity air or water, but it has a drawback that the glass is not durable under such a high-voltage condition as electric discharge.

The exposure of the electric conductor of the electric discharger to the high-humidity air or water results in ① a reduction of insulation resistance of the dielectric member due to a change of an electrostatic capacity of the electric conductor and ② a failure of electric discharge due to adhesion of environmental gas (silicon gas, ammonia or the like) to the electric conductor, which are causes of impeding generation of ozone. In this connection, in order to insulate the electric conductors from the high-humidity air or water, means for covering the electric conductors with the glass or dielectric member has been considered to be important. However, since the glass is disadvantageous in durability as mentioned above, it has been aimed to develop an electric discharger which ① utilizes a substitute for glass, ② has such a mechanical strength that the electric discharge occurs stably in the high-humidity air or water, and ③ makes use of the discharge property in the high-humidity air or water which is different from that in the dry air.

As a result, a low-temperature plasma generator has been developed in which rod-like electric conductors are inserted in through-holes formed in rod-like ceramics dielectric members and extending in longitudinal directions thereof, both ends of the electric conductors and the dielectric members are integrally joined and sealed by glass, an inorganic adhesive or an organic adhesive, so as to constitute a plurality of electrodes, and the electrodes are connected to each other through the ceramics dielectric members in substantially line-contacted relation. The electric conductors may be made of electrically conductive ceramics or the like, in place of metal. The cross-sectional shapes of the electric conductors and the ceramics dielectric members may be polygonal, respectively, but both of them may be preferably not angular but smooth, and more preferably circular.

As the adhesive for joining and sealing the electric conductors and the dielectric members, in addition to glass (fused at 400° to 1800° C. , typically at 800° to 1200° C. ) which has conventionally been used widely, there can be used such an inorganic adhesive as containing sodium silicate, alumina-gel, chromium oxide, calcium silicate, a boric oxide-lead oxide-zinc oxide type compound, and a boric oxide-lead oxide-silicon oxide type compound (to which silica, alumina and zirconium oxide are sometimes added). The inorganic adhesive is thermally treated to be cured at ordinary temperature to 1500° C., typically at 600° to 1200° C.

As the organic adhesive, there can be used, for example, a phenolic resin type adhesive, an α-olefin resin type adhesive, an epoxy resin type adhesive, a vinyl acetate resin type (solution type) adhesive, a vinyl acetate resin emulsion type adhesive, an acrylic emulsion type adhesive, a cyano acrylate type adhesive, a polyurethane type adhesive, a chloroprene rubber type adhesive, a nitrile rubber type adhesive, an SBR type adhesive, an ethylene copolymer resin type adhesive, and a cellulosic adhesive. As the sealing agent, there can be used polysulfide type, silicon type, metamorphosed silicon type, polyurethane type, acrylic and butyl rubber type sealing agents. These adhesives and sealing agents are dried at the ordinary temperature to 200° C. so as to be cured.

Alternatively, differently from the electric discharger having the above-described structure, the present invention provides a low-temperature plasma generator in which a plurality of rod-like electric conductors are inserted in through-holes formed in a plate-like ceramic dielectric material at certain intervals. The through-holes extend along the surfaces of the dielectric material in a longitudinal direction thereof. Both ends of the electric conductors and the dielectric material are integrally joined and sealed by glass, or an inorganic or organic adhesive so as to constitute electrodes in a group. Grooves are formed on the surfaces of the ceramics dielectric material substantially intermediate between the adjacent rod-like electric conductors of the electrodes of the group, the grooves extending in the longitudinal direction of the dielectric material. It is preferable that the cross-sectional shape of the electric conductor is circular, and that each groove provided on the ceramics dielectric material has offset arcuate side walls which are opposite to each other.

In the low-temperature plasma generator of the present invention, because the electric conductors and the dielectric members which are made of different substances are bonded and sealed, it is preferred to apply a surface treatment agent containing a metallic element or a rare earth element, or inorganic salt or an organic metallic compound including such element, on the surfaces of the rod-like electric conductors and the rod-like dielectric members or plate-like dielectric material, and then to thermally treat the surface treatment agent.

The surface treatment agent is a solution in which a metallic element such as Si, Ti, Al, Zr, W, Mo, V, Mn, Fe, Co, Ni, Cu, Zn or the like or a rare earth element, an organic matter or inorganic salt individually or in plural containing such metallic elements or rare earth elements, is dissolved. After applying the surface treatment agent on the surfaces of the electric conductors and the dielectric material or members, the agent is thermally decomposed at typically 600° to 800° C. so as to be oxidized. There exists an agent made of a material which has only to be thermally treated to transpire.

In the above-described plasma generator, it is preferred to provide a minute gap between the rod-like electric conductors and the rod-like ceramics dielectric members or plate-like ceramics dielectric material so that they may not be in contact with each other, thus constituting the electrodes or the electrodes in the group. It is also preferred to coat the electrodes or the electrodes of the group with a glassy substance. This glassy substance may be a glaze which is used when baking, for example, china, in addition to generally-available glass such as silicate glass, borate glass, phosphate glass or the like.

According to the low-temperature plasma generator, since the electric conductors are covered with the ceramics dielectric member, a change of the electrostatic capacity of the ceramics dielectric member can be suppressed as much as possible, and the environmental gas can also be prevented from adhering to the electric conductors. It is thus possible to stably realize electric discharge in any condition such as dry air, high-humidity air and water, to thereby generate low-temperature plasma efficiently. In consequence, oxygen molecule is dissociated to generate ozone in the dry air, and water molecule or the like is dissociated to generate hydroxyl group in the high-humidity air or water, thereby causing an oxidizing reaction mainly of organic matter. Further, the mechanical strength of the ceramics dielectric member is enormously greater than that of the glass, so that the mechanical strength of the low-temperature plasma generator can be enhanced.

In the low-temperature plasma generator having the structure that the rod-like electric conductor is covered with the rod-like ceramics dielectric member, the cross-sectional shapes of the conductor and the dielectric member are circular, respectively. According to such generator, ① a distance from the conductor peripheral surface to the dielectric member side surface is constant in the radial direction so that electric potential is uniformly distributed in the radial direction, in other words, deflection of electric discharge is eliminated; ② the plurality of electrodes can easily be connected to each other by an adhesive in substantially line-contacted relation side by side; and ③ the opposite side surfaces of the dielectric members which are arcuately formed opposite to each other can be formed as discharge surfaces with an appropriate interval.

In the low-temperature plasma generator having the structure in which the plurality of rod-like electric conductor are covered with the plate-like ceramics dielectric material, the cross-sectional shapes of the conductors are circular and the grooves provided on the ceramics dielectric material have the side walls which are arcuately formed opposite to each other. According to this generator, it is possible to fulfill the abovedescribed functions ① and ③.

The surface treatment agent is thermally decomposed under such a condition that the contained metallic element or rare earth element, inorganic salt or an organic metallic compound is stuck to the surfaces of the electric conductor and the dielectric member, so as to produce oxide. As a result, physical or chemical properties of the surfaces of the respective materials are made to resemble each other. Also, the electric conductor (metal or electrically-conductive ceramics), insulator (ceramics) and sealing member (glass or an inorganic or organic adhesive) which are made of different substances, are given adhering properties similar to one another. The surface treatment agent acts as a buffer for absorbing expansion of the above members ocurring due to application of high voltage, which members are made of the above-described substances having different coefficients of thermal expansion, thus ensuring a strength of mechanical connection of the electrodes.

The gap provided between the rod-like electric conductor and the ceramics dielectric member restrains damage of the electric conductor due to the electric discharge and ensures durability of the conductor for a longer period of time. As a result of suppressing heat generation attending on the electric discharge, energy required for dissociating the oxygen molecule or water molecule can effectively be extracted from applied voltage. By further coating the low-temperature plasma generator comprising the above-described electrodes with a glassy substance, an insulation property, moisture-proofing property and water-proofing property of the generator can be improved, and discharging performance of the low-temperature plasma generator can be enhanced, particularly, in the high-humidity air or water.

DETAILED DESCRIPTION OF THE INVENTION

Preferred embodiments of a low-temperature plasma generator according to the present invention will be described hereinafter with reference to the accompanying drawings.

Figure 1:
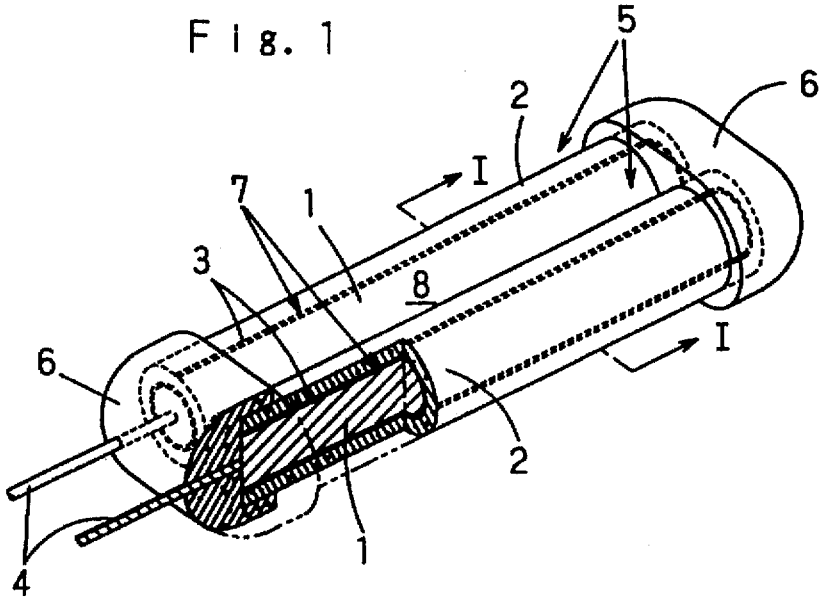
FIG. 1 is a partially cutaway perspective view of a low-temperature plasma generator comprising two electrodes.
Figure 2:
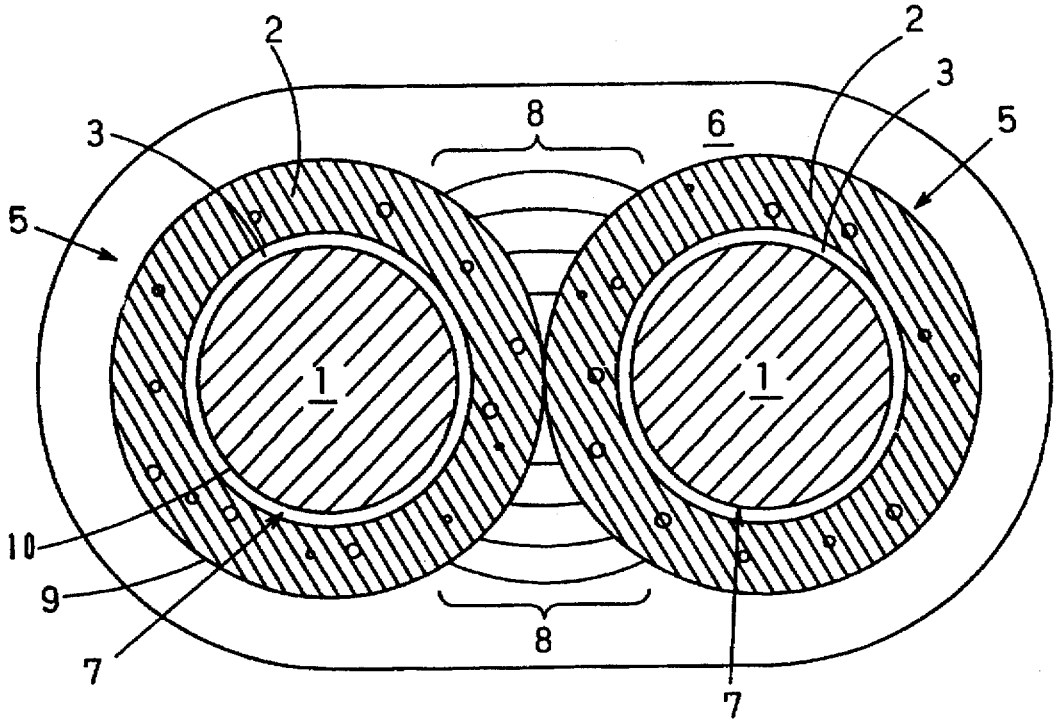
FIG. 2 is a cross-sectional view of the low-temperature plasma generator, taken along a line I—I of FIG. 1.

FIG. 1 is a partially cutaway perspective view of the low-temperature plasma generator in which metallic rod-like electric conductors 1 are respectively inserted in through-holes 3 formed in thin-walled cylindrical ceramics dielectric members 2 and extending in longitudinal directions of the dielectric members, and lead wires 4 from a high-voltage AC power source are connected to one ends of the electric conductors 1 to be directed in the same directions so as to constitute two electrodes 5, the electrodes being connected to each other in line-contacted relation. In the drawing, the line-contacted electrodes extend substantially in parallel. Both ends of the dielectric members 2 and the electric conductors 1 are covered with sealing members 6 made of ceramics. FIG. 2 is a cross-sectional view of the low-temperature plasma generator, taken along a line I—I of FIG. 1.

In each electrode 5 constituting the low-temperature plasma generator, as shown in FIG. 1, the rod-like electric conductor 1 and the ceramics dielectric member 2 both have circular cross-sections. There is a minute gap 7 between the electric conductor 1 and the dielectric member 2 so that opposite surfaces thereof may not be in contact with each other. It is considered that the gap 7 serves to prevent oxidation of the electric conductor due to electric discharge and to prolong the span of life of the electric conductor. Typically, the rod-like electric conductor 1 has a diameter of 0.6 to 4.5 mm, the ceramics dielectric member 2 has a diameter of 1 to 5 mm, the gap 7 has a dimension of about 1 mm or less, and the lengths of these members are approximately 25 to 50 mm. These numerical values may desirably be determined depending on a required shape and capacity of the plasma generator. The electric conductor 1 and the dielectric member 2 are applied with a surface treatment agent. After thermally decomposing the surface treatment agent, the sealing members 6 made of glass are fused to the both ends of the electric conductor and the dielectric member, thereby sealing them.

Employed as the surface treatment agent to be applied on the surfaces of the electric conductor 1 and the dielectric member 2 is an organic compound such as Si, Zr or Al or a solution in which inorganic salt containing aluminum is dissolved. The electric conductor 1 and the dielectric member 2 are immersed in the above solution in such a state that the electric conductor is being inserted in the dielectric member. Then, the surface treatment agent is thermally decomposed to produce oxide on the surfaces of the electric conductor 1 and the dielectric member 2. The conventionally-available glass is used for the sealing member 6.

As shown in FIG. 2, discharge surfaces 8 formed between the electrodes 5, 5 consist of side surfaces 9 of the dielectric members, which are arcuately formed opposite to each other, as clearly be seen from the cross-sectional view of FIG. 2. In each electrode 5, a distance between an outer peripheral surface 10 of the electric conductor and the side surface 9 of the dielectric member is constant in the radial direction. As a result, the discharge surfaces 8 formed by the side surfaces 9 of the dielectric members are equipotential. The electric discharge occurs in a region where a distance between the opposite side surfaces of the dielectric members is short, or in a region within a predetermined distance from the line-contacted portion between the dielectric members. In addition, the occurrence and intensity of the electric discharge depend on the diameters of the electric conductor and the dielectric member, the distance between the discharge surfaces, and a magnitude and a frequency of AC voltage to be applied. In this embodiment, because the number of the electrodes is two, the discharge surfaces 8 are formed at only two portions above and below the line-contacted portion between the dielectric members.

According to the low-temperature plasma generator of the present invention, because the electric conductors 1 are sealed with the ceramics dielectric members 2 and the sealing members 6, the electric discharge can be carried out stably under various circumstances without being influenced by environmental gas. Low-temperature plasma generated by this electric discharge dissociates oxygen molecule ($O_2$) in dry air to produce ozone ($O_3$) and water molecule ($H_2O$) in high-humidity air or water to produce hydroxyl group (O—H). Particularly, an oxidizing reaction of an organic substance takes place in the high-humidity air or water. It is thus possible to carry out such a function as disinfection, sterilization, deodorization or the like, due to oxidizing power of the ozone in the dry air or the hydroxyl group in the high-humidity air.

Figure 3:
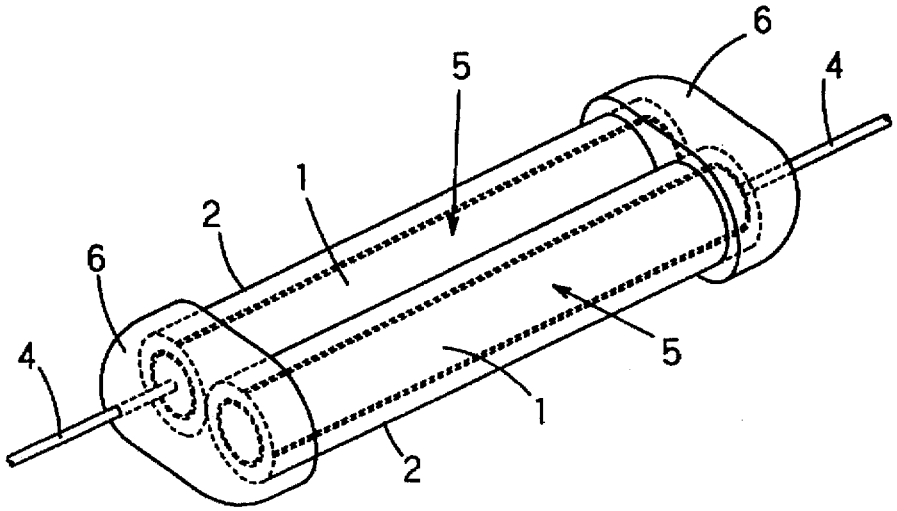
FIG. 3 which is similar to FIG. 1, is a perspective view of a low-temperature plasma generator in which lead wires are connected to electrodes be be directed in different directions.
Figure 4:
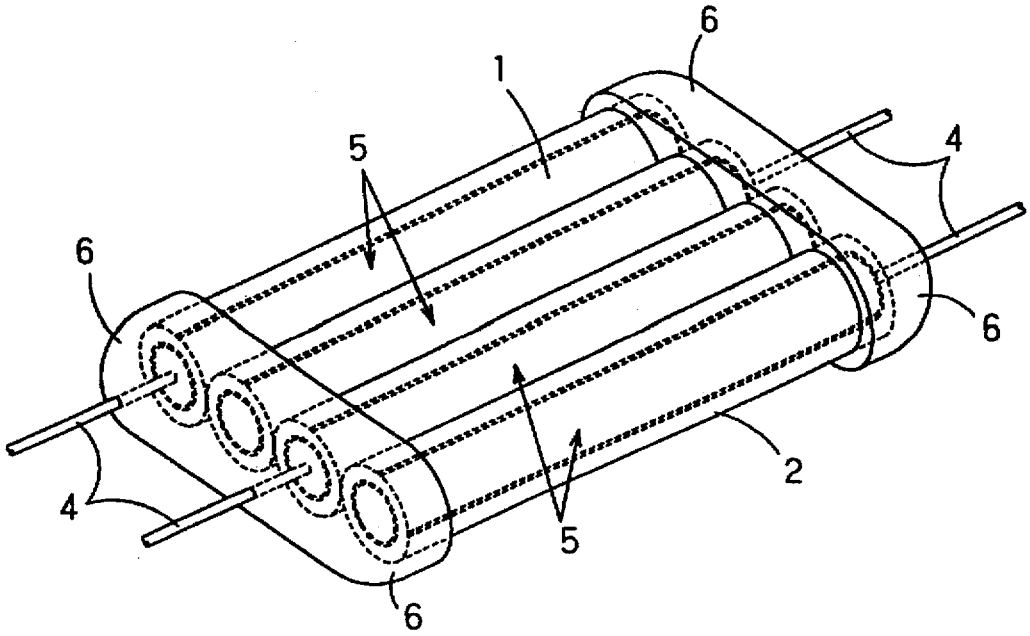
FIG. 4 similar to FIG. 1, is a perspective view of a low-temperature plasma generator comprising four electrodes.
Figure 5:
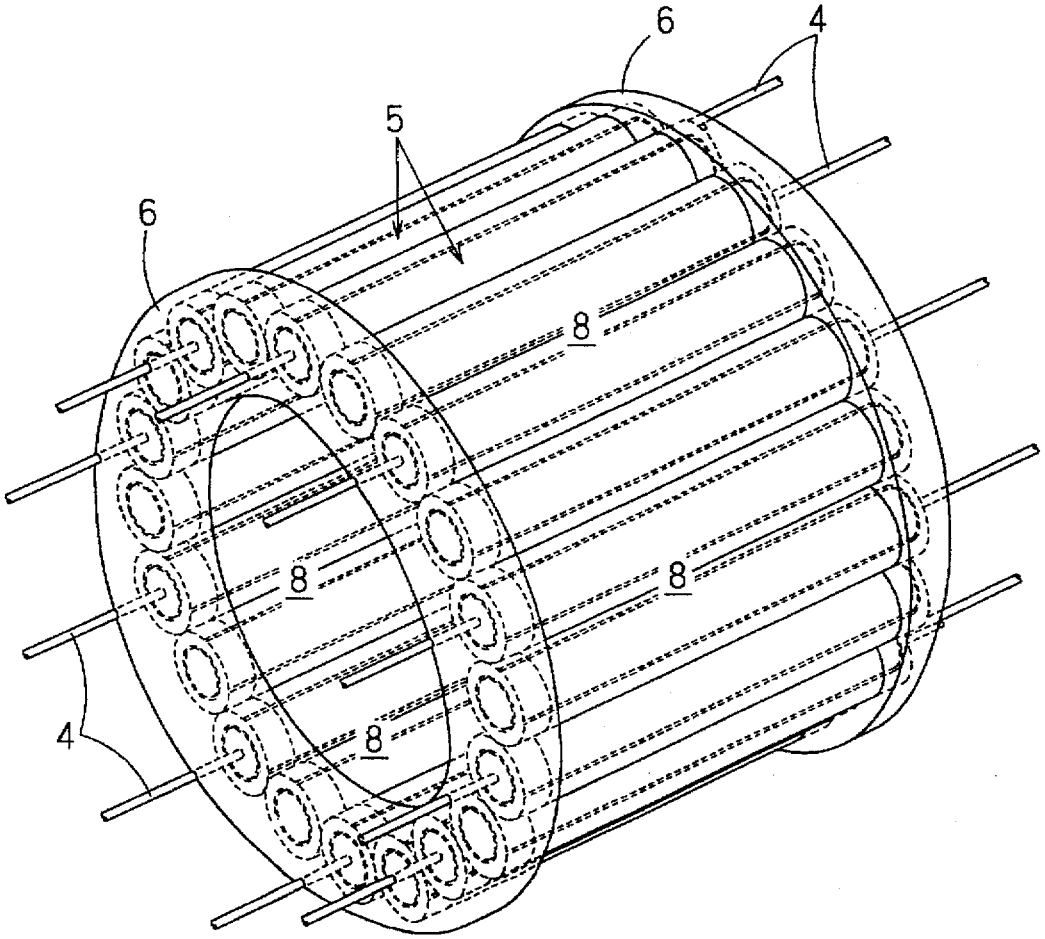
FIG. 5 similar to FIG. 1, is a perspective view of a low-temperature plasma generator comprising electrodes arrayed in a cylindrical shape.

The structure of the low-temperature plasma generator may be modified in various manners in place of the above structure. FIG. 3 which is similar to FIG. 1, is a perspective view of a low-temperature plasma generator in which lead wires 4 from a high-voltage AC power source are connected to two electrodes 5 to be directed in different directions; FIG. 4 similar to FIG. 1 is a perspective view of a low-temperature plasma generator in which lead wires 4 from a high-voltage AC power source are connected to four electrodes 5 to be directed in different directions; and FIG. 5 is a perspective view of a low-temperature plasma generator in which electrodes 5 each comprising a metallic rod-like electric conductor 1 and a ceramics dielectric member 2 covering the conductor 1 (similarly to FIG. 1) are arrayed in a cylindrical shape. The low-temperature plasma generator of the present invention thus has an advantage in that its structure can be freely designed.

The polarities of the electrodes constituting the low-temperature plasma generator are freely set, and accordingly it is possible to arbitrarily connect the lead wires to the electrodes. This advantageous construction is exemplified in FIG. 3, and FIG. 4 shows a modified example of the same. Further, as seen in, for example, FIG. 5, when a number of electrodes 5 are arrayed in the cylindrical shape, the array of the electrodes is endless so that there is no electrode which locates at an end of the array. In consequence, the discharge surfaces 8 are formed between all the adjacent electrodes 5, 5. That is, because the cross-section of the array of the electrodes is circular, the discharge surfaces 8 as shown in FIG. 2 are formed between any pair of electrodes 5, 5. Therefore, the effective electric discharge can be expected.

Figure 6:
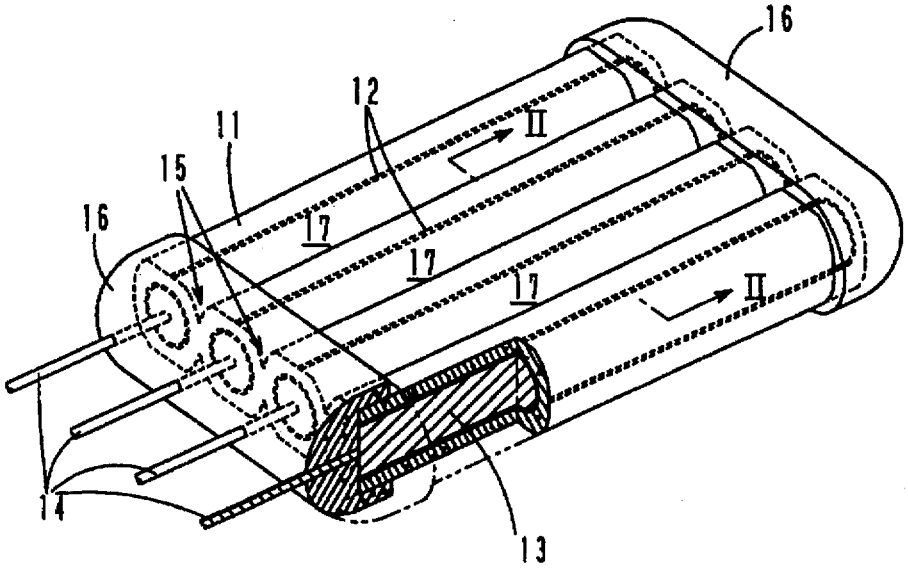
FIG. 6 is a partially cutaway perspective view of a low-temperature plasma generator which utilizes a plate-like dielectric material.
Figure 7:
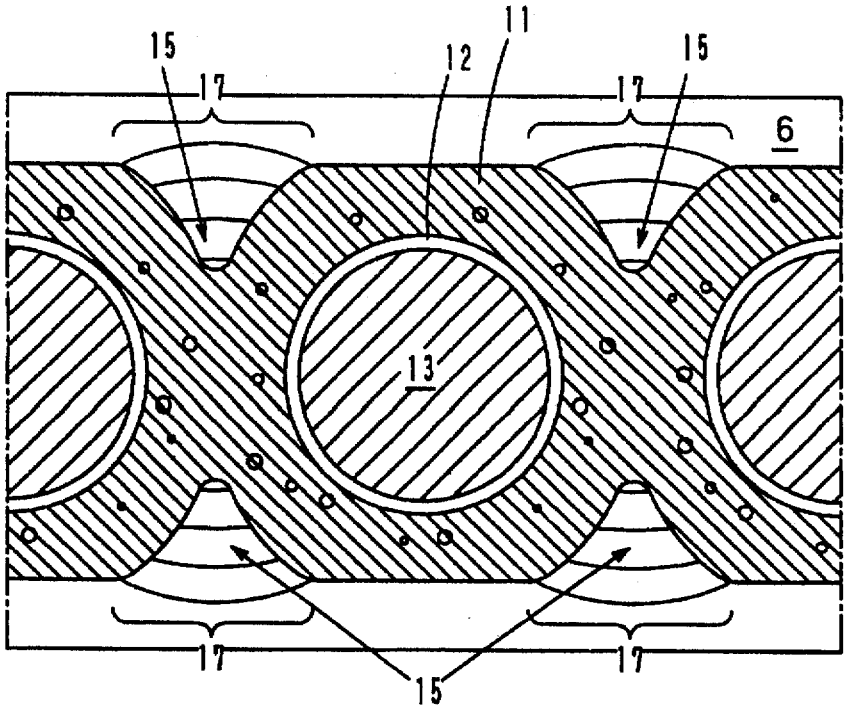
FIG. 7 is a cross-sectional view of the low-temperature plasma generator, taken along a line II—II of FIG. 6.

In the low-temperature plasma generator of the invention, when the ceramics dielectric members are previously formed as an integrated material, it becomes unnecessary to connect the electrodes so that the productivity and mechanical strength can be improved. In this connection, FIG. 6 is a partially cutaway perspective view of a low-temperature plasma generator in which metallic rod-like electric conductors 13 are inserted in through-holes 12 formed in a plate-like ceramics dielectric material 11 and extending in the longitudinal direction of the material. Thus, the electrodes are constituted in a group. The electrodes extend in parallel relation with one another. Grooves 15 (each having arcuate side walls) are formed on the surfaces of the ceramics dielectric material 11 intermediate between the adjacent rod-like electric conductors 13, the grooves extending in the longitudinal direction of the dielectric material 11. A surface treatment agent is applied on the surfaces of the electric conductors 13 and the dielectric material 11, and then thermally decomposed. Thereafter, lead wires 14 from a high-voltage AC power source are connected to one ends of the electric conductors 13 to be directed in the same directions, and both ends of the dielectric material 11 and the electric conductors 13 are covered with sealing members 16 of ceramics. FIG. 7 is a cross-sectional view of the low-temperature plasma generator, taken along a line II—II of FIG. 6.

As will be understood when comparing FIG. 6 with FIG. 1, the above-described embodiment in which the separately manufactured electrodes are connected to each other by an adhesive, and this embodiment in which the electrodes are manufactured in one piece, are substantially the same in respect of structure. However, because the ceramics dielectric material 11 covering the rod-like electric conductors 13 is formed as an integrated material differently from the embodiment in which the dielectric members each covering the associated electric conductor are connected to each other by an adhesive, the low-temperature plasma generator of FIG. 6 has advantages such that: ① the manufacturing steps can be simplified; and ② the mechanical strength of the low-temperature plasma generator can be improved.

As will be understood from comparison between FIG. 7 and FIG. 2, the side walls of each groove 15 provided on the plate-like ceramics dielectric material 11 are arcuately formed opposite to each other, so that discharge surfaces 17 are substantially similar to those of the aforesaid embodiment in which the ceramics dielectric members having the circular cross-sections are line-contacted with each other. Incidentally, if there remains an angular portion in the groove, as viewed in cross section, applied voltage is deflected so that the electric discharge concentrates on that angular portion. As a result, deterioration unfavorably occurs locally at the angular portion. Therefore, it is preferable that the groove has the side walls which are arcuately formed opposite to each other or which extend smoothly, as shown in the cross-sectional view of FIG. 7.

According to the low-temperature plasma generator of the present invention, since the electric conductors are covered with ceramics which can withstand the application of high-voltage alternating current and sealed by the sealing members, the electric discharge can be carried out stably under any circumstances such as dry air, high-humidity air and water. More specifically, in the dry air, oxygen molecule is dissociated to produce ozone due to the electric discharge as in the conventional art, and in the high-humidity air or water, water molecule is dissociated due to low-temperature plasma, so as to achieve an oxidizing reaction of an organic substance. Thus, it is possible to carry out a function such as disinfection, sterilization, deodorization or the like due to the electric discharge under various circumstances.

The discharge surfaces can be appropriately constituted by the electric conductors and the ceramics dielectric members having the circular cross-sections without being subjected to any special machining or processing, so that the efficient electric discharge can be obtained. The gap provided between the electric conductor and the ceramics dielectric member serves not only to prevent wear of the electric conductor but also to suppress production of heat resulting from the electric discharge, thereby efficiently obtaining energy required for dissociating the oxygen molecule or water molecule due to the electric discharge. As has hitherto been described, by virtue of both the stability of the electric discharge and the efficiency of extraction of the dissociation energy, the low-temperature plasma generator of the invention is advantageous in that consumption of electric power required for the electric discharge can be suppressed and the cost upon use can be decreased.

Moreover, it is also possible to reduce the manufacturing cost by forming the ceramics dielectric members for covering the electric conductors into the integrated plate-like material. Thus, the low-temperature plasma generator of the invention is superior to the conventional electric discharger in respect of cost. Because the low-temperature plasma generator can discharge electricity under various circumstances like as the dry air, high-humidity air and water, it can be used for such various purposes as to purify drinking water through a domestic alkali water purifier or a clarifier or water in a pool, to remove a bad smell emitted from a cigarette, a pet, refuse or the like, to destroy an offensive odor in a toilet, to sterilize mold or bacteria, and to preserve freshness of food in a refrigerator or freezer.

What is claimed is:

1. A low-temperature plasma generator comprising electric rod conductors inserted in through-holes formed in rod ceramic dielectric members and extending in longitudinal directions thereof, both ends of said electric conductors and said dielectric members are integrally joined and sealed by glass or an inorganic or organic adhesive, so as to constitute a plurality of electrodes, and the electrodes are connected to each other through the ceramic dielectric members in a substantially line-contacted relation; and a glassy ceramic coating on the surfaces of said electric rod conductors and said ceramic dielectric members, said glassy ceramic coating made by a process comprising applying a surface treatment agent containing a member selected from the group consisting of a metallic element, a rare earth element, inorganic salt and an organic metallic compound including one of such elements, on surfaces of the electric rod conductors and the ceramic dielectric rod members, and then thermally decomposing said surface treatment agent.

2. A low-temperature plasma generator comprising a plurality of electric rod conductors inserted in through-holes formed in a ceramic dielectric plate material at certain intervals and extending longitudinally along surfaces of the dielectric plate material, both ends of said electric conductors and said dielectric plate material are integrally joined and sealed by glass or an inorganic or organic adhesive, so as to constitute electrodes in a group, and grooves are provided on a top and bottom surface of the ceramic dielectric material substantially intermediate between adjacent electric rod conductors of said electrodes of the group, the grooves extending in the longitudinal direction of the dielectric plate material; and a ceramic coating on the surfaces of said elastic rod conductors and said ceramic dielectric plates, said ceramic coating made by the process comprising applying a surface treatment agent containing a member selected from the group consisting of a metallic element, a rare earth element, inorganic salt and an organic metallic compound including one of such elements on surfaces of the electric rod conductors and the ceramic dielectric plate material, and thermally decomposing the surface treatment agent.

* * * * *